United States Patent [19]

Masuhara et al.

[11] Patent Number: 4,533,892

[45] Date of Patent: Aug. 6, 1985

[54] SPLIT STRUCTURE TYPE TRANSFORMER

[75] Inventors: Hideki Masuhara; Kunio Katada; Uichi Kudo, all of Hitachi, Japan

[73] Assignee: Hitachi, Ltd., Tokyo, Japan

[21] Appl. No.: 506,515

[22] Filed: Jun. 21, 1983

[30] Foreign Application Priority Data

Jun. 23, 1982 [JP] Japan ..... 57-106681
Aug. 25, 1982 [JP] Japan ..... 57-147189

[51] Int. Cl.[3] ..... H01F 21/12

[52] U.S. Cl. ..... 336/147; 323/340; 323/346; 336/150

[58] Field of Search ..... 323/340, 344, 345, 346, 323/347, 348; 336/145, 146, 147, 150

[56] References Cited

U.S. PATENT DOCUMENTS 3,691,495 9/1972 Conway ..... 336/147

FOREIGN PATENT DOCUMENTS 1258967 1/1968 Fed. Rep. of Germany ..... 336/145
0118522 9/1979 Japan ..... 323/340
93904 6/1920 Switzerland ..... 323/340

*Primary Examiner*—Reinhard J. Eisenzopf
*Attorney, Agent, or Firm*—Antonelli, Terry & Wands

[57] ABSTRACT

A split structure type transformer has a core upper and lower split-up secondary windings and a primary winding which are wound about the core, a single tap winding having a plurality of tap winding parts and a plurality of tap terminals, and a single tap selector. The secondary windings are respectively connectable to independent loads, with only one end of the tap winding being connected to the primary winding, and the tap terminals are respectively connected to terminals of the tap selector. A pair of tap winding parts, connected to the same terminal of the tap selector, are arranged adjacently along the axial direction of winding. Each of the tap winding part pairs may be replaced by a single tap winding part which is formed by winding a single strand having a cross-sectional area which is twice a cross-sectional area of a strand used for winding each tap winding part pair.

9 Claims, 7 Drawing Figures

SPLIT STRUCTURE TYPE TRANSFORMER

The present invention relates to a split structure type transformer having two split secondary windings, and, more particularly, to a transformer of this type suitable for separation of a tap winding and common use of a single tap selector.

A split structure type transformer generally comprises two split secondary windings (low voltage windings) wound about a core leg along an axial direction thereof; and a primary winding (high voltage winding) concentric with the secondary windings and having two primary winding parts corresponding to the two secondary windings. Usually, the split structure type transformer has a tap winding separate from the primary winding and concentric with the secondary and primary windings as in the other types of transformer, and a single tap selector which is in common use for selection of taps of the tap winding.

As schematically shown in FIG. 1*a*, a prior art split structure type transformer includes a core 1 comprised of a yoke 1A and a leg 1B, and upper and lower split-up secondary windings 2A and 2B along an axial direction of the core leg 1B. Independent loads may be connected across terminals $u_1$ and $v_1$ of the winding 2A and across terminals $u_2$ and $v_2$ of the winding 2B, respectively. A primary winding part 3A of a primary winding 3 is associated with the secondary winding 2A concentrically therewith, and a primary winding part 3B is associated with the secondary winding 2B concentrically therewith. The primary winding parts 3A and 3B constitute the single primary winding 3. One ends of the respective primary winding parts 3A and 3B are connected to a common junction from which a terminal U is derived. The terminal U is connected to one phase of a three-phase AC power source. Two tap windings 4A and 4B are adapted to adjust the voltage of the primary winding 3 and they are wound about the primary winding 3 concentrically therewith. The tap winding 4A has tap winding parts 12Na, 13Na, 14Na and 15Na, and tap terminals 11A, 12A, 13A, 14A and 15A which extend from connecting lines of the tap winding parts. Similarly, the tap winding 4B has tap winding parts 12Nb, 13Nb, 14Nb and 15Nb, and tap terminals 11B, 12B, 13B, 14B and 15B which extend from these tap winding parts. A single tap selector 5 has selector tap terminals $T_1$, $T_2$, $T_3$, $T_4$ and $T_5$. The terminal $T_1$ is connected to the tap terminals 11A and 11B, the terminal $T_2$ to the tap terminals 12A and 12B, the terminal $T_3$ to the tap terminals 13A and 13B, the terminal $T_4$ to the tap terminals 14A and 14B, and the terminal $T_5$ to the tap terminals 15A and 15B. Thus, the primary winding parts 3A and 3B are connected in parallel to each other. One of the terminals $T_1$ to $T_5$ is selected by manually or automatically transferring the tap selector 5 so as to be connected to a neutral as shown in FIG. 1*a* or another phase. In an illustrated example, the number of tap terminals of each tap winding is only five but actually, a great number of tap terminals are derived.

To detail the connection of the tap winding 4A or 4B, the tap winding parts 12Na, 13Na, 14Na and 15Na lie between adjacent tap terminals of the tap winding 4A and in particular, the tap winding part 12Na intervenes between the tap terminals 11A and 12A, the tap winding part 13Na between the tap terminals 12A and 13A, the tap winding part 14Na between the tap terminals 13A and 14A, and the tap winding part 15Na between the tap terminals 14A and 15A. These tap winding parts 12Na, 13Na, 14Na and 15Na are arranged in sequence as illustrated along an axial direction of the leg 1B of the core 1. The arrangement of the tap winding parts 12Nb, 13Nb, 14Nb and 15Nb of the tap winding 4B is similar to that of the tap winding parts 12Na, 13Na, 14Na and 15Na and will not be described. When the tap selector 5 is transferred to the terminal $T_1$, no tap winding parts are inserted into the connection of the primary winding 3. With the terminal $T_2$ selected, the winding parts 12Na and 12Nb are inserted; with the terminal $T_3$ selected, the winding parts 12Na and 13Na as well as the winding parts 12Nb and 13Nb are inserted; with the terminal $T_4$ selected, the winding parts 12Na, 13Na and 14Na as well as the winding parts 12Nb, 13Nb and 14Nb are inserted; and with the terminal $T_5$ selected, all the tap winding parts are inserted.

Incidentally, in the split structure type transformer, the two secondary windings 2A and 2B are usually respectively connected with loads so that the secondary windings 2A and 2B, primary winding parts 3A and 3B, and tap windings 4A and 4B are all in operation and leakage fluxes permeating the tap windings 4A and 4B are balanced. However, it often happens for some reasons that only one of the secondary windings 2A and 2B is loaded. For example, in the event that only the secondary winding 2A is loaded, the secondary winding 2A, primary winding part 3A and tap winding 4A are activated while the secondary winding 2B, primary winding part 3B and tap winding 4B are deactivated. As a result, leakage fluxes permeating the tap winding 4A and 4B are unbalanced as will be described with reference to FIG. 1*b*.

In FIG. 1*b*, abscissa represents magnetic flux density B and ordinate represents a total height h of the tap windings which is parallel to the axial direction of the leg 1B of core 1. A leakage flux permeating the tap winding 4A is illustrated by a solid curve 10A and a leakage flux permeating the tap winding 4B is illustrated by a dotted curve 10B. In the tap winding 4B, the leakage flux is reversely directed but distributed as in the tap winding 4A. Accordingly, when both the secondary windings 2A and 2B are in use, leakage fluxes as represented by solid curve 10A and dotted curve 10B take place simultaneously and the magnetic flux distribution balances. However, when one of the secondary windings, for example, 2A alone is loaded, only the leakage flux represented by solid curve 10A takes place while the leakage flux due to the secondary winding 2B is nullified as shown by a solid line 10C resulting in the magnetic flux distribution being unbalanced as a whole.

Voltages developing in the tap windings 4A and 4B as a result of the permeation of the leakage magnetic flux will be discussed with reference to FIGS. 1*a* and 1*b*. For example, since the tap winding parts 12Na and 12Nb of the tap windings 4A and 4B are symmetrically disposed, it will be seen from the magnetic flux distribution shown in FIG. 1*b* that voltages of the same magnitude and opposite polarities respectively develop across the parts 12Na and 12Nb, when the magnetic flux distribution balances. Voltage developing across the winding parts 13Na and 13Nb as well as the winding parts 14Na and 14Nb are held in a similar relationship. However, since each pair of the symmetrical tap winding parts are connected in parallel through corresponding selector tap terminals, the voltages due to the leakage flux are cancelled out and they are not accompanied by current flows in the tap winding parts.

However, when one of the secondary windings 2A and 2B, for example, 2A is in use, the leakage flux represented by dotted curve 10B is nullified as shown by solid line 10C. Consequently, voltages due to the leakage flux represented by solid curve 10A develop only across the winding parts of the tap winding 4A with the result being of the occurrence of circulating current flows between the paired winding parts 12Na and 12Nb, in the direction as indicated by the arrows, between the winding parts 13Na and 13Nb, between the winding parts 14Na and 14Nb, and between the winding parts 15Na and 15Nb.

In this manner, with the prior art tap winding arrangement as shown in FIG. 1*a*, large circulating currents occur in the tap winding when only one of the secondary windings 2A, 2B is loaded so that load loss of the transformer is increased and impedance thereof is adversely affected.

It is an object of the present invention to provide a split structure type transformer capable of suppressing circulating currents in the tap winding to reduce the load loss and eliminate adverse influence upon the impedance.

Another object of the present invention is to provide a split structure type transformer which can permit independent use of loads respectively connected to two split-up secondary windings.

According to one aspect of the present invention, there is provided a split structure type transformer comprising a core having a leg; two split-up secondary windings wound about the leg of the core along an axial direction of the leg and connectable to independent loads; and a primary winding including two primary winding parts wound about the two secondary windings corresponding thereto and concentrically therewith along the axial direction of the leg, with the two primary winding parts being connected in parallel to each other. A single tap winding is wound about the primary winding and secondary windings concentrically therewith and includes a plurality of tap winding parts connected in series with each other and a plurality of tap terminals. A single tap selector is connected to the tap terminals of the tap winding to select one of the tap terminals. Wherein only one end of the tap winding is connected to the primary winding.

According to another aspect of the present invention, there is provided a split structure type transformer comprising: a core having a leg; two split-up secondary windings wound about the leg of the core along an axial direction of the leg and connectable to independent loads; and a primary winding including first and second primary winding parts wound about the secondary windings corresponding thereto and concentrically therewith along the axial direction of said leg, with the first and second primary winding parts being connected in parallel, whereby said primary winding has a first common terminal to be connected to a power source and a second common terminal. A single tap winding is wound by a single strand about said primary winding and secondary windings concentrically therewith and includes a plurality of tap winding parts connected in series, with a plurality of tap terminals and a single tap selector connected to the tap terminals of the tap winding to select one of said tap terminals. Only one end of the tap winding is connected to said second common terminal of said primary winding.

BRIEF DESCRIPTION OF THE DRAWINGS

FIG. 2*b* is a leakage flux distribution in a tap winding of the transformer in FIG. 2*a.

In FIG. 2*a* a transformer is provided which has a single tap winding 6. It is significantly important to understand that, as shown in FIG. 1*a*, while in the prior art split structure type transformer has two split-up tap windings, the tap winding 6 in the embodiment of FIG. 2*a* is not split up to form a single tap winding but rather the single tap winding 6 has tap winding parts which are interconnected and connected to a single tap selector 5 as will be described more fully hereinbelow.

Figure 1B:
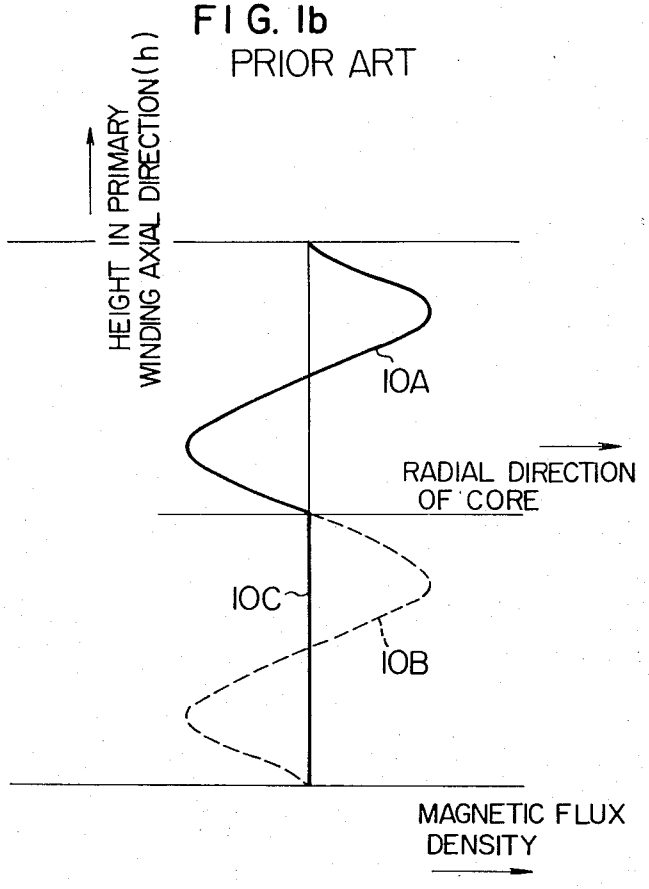
FIG. 1b PRIOR ART
FIG. 1*b* is a leakage flux distribution in a tap winding of the transformer in FIG. 1*a;*
Figure 1A:
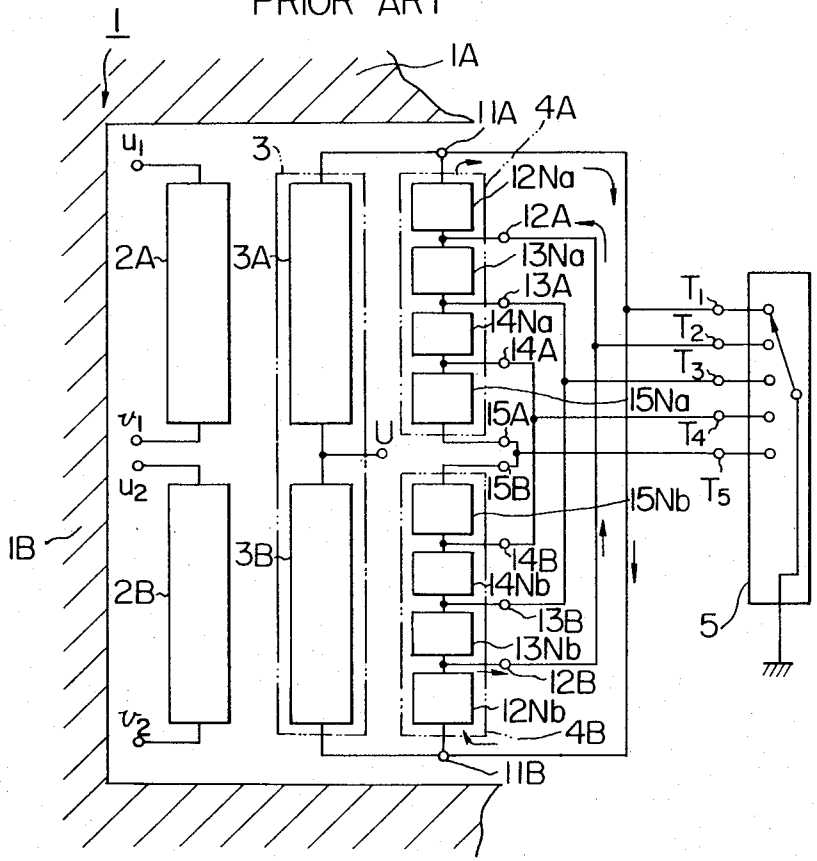
FIG. 1a PRIOR ART
FIG. 1*a* is a schematic view illustrating a construction in connection of a prior art split structure type transformer.
Figure 2B:
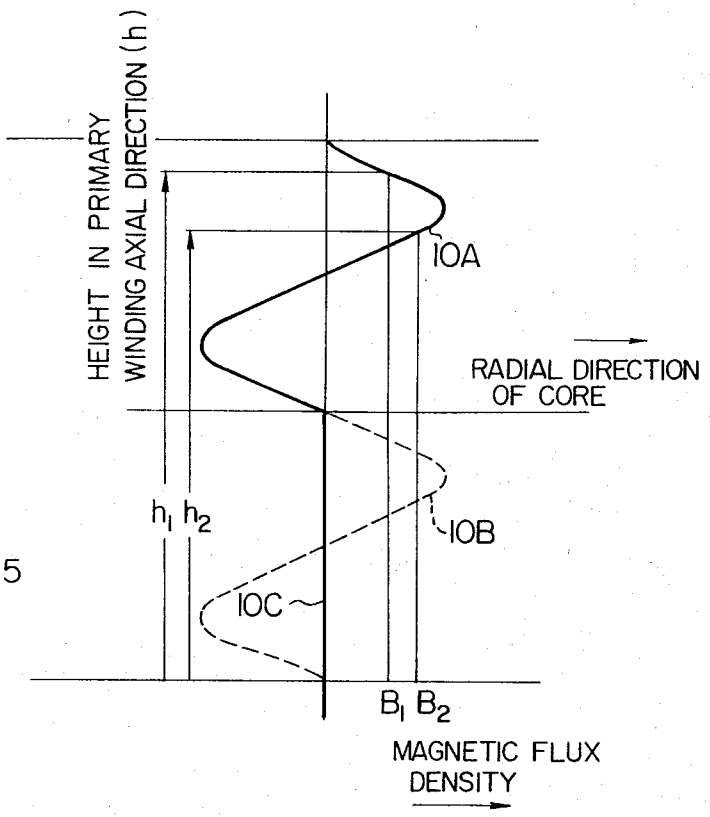
Figure 2A:
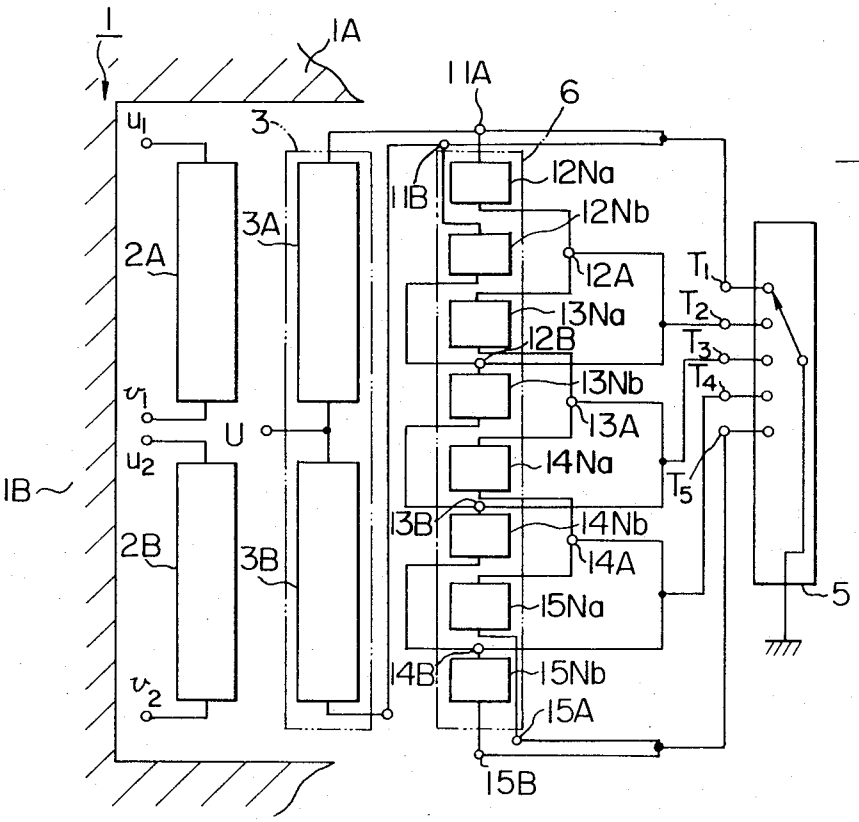
FIG. 2*a* is a schematic view illustrating a construction in connection of a first embodiment of a split structure type transformer according to the present invention.

In order to obtain a better understanding of the relationship between winding parts arrangement in the single tap winding 6 and that in the tap windings 4A and 4B of the prior art transformer, tap winding parts in FIG. 2*a* are denoted by reference numerals corresponding to the tap winding parts in FIG. 1*a*. In accordance with the present invention, the tap winding 6 has winding parts 12Na, 12Nb, 13Na, 13Nb, 14Na, 14Nb, 15Na and 15Nb which are arranged in the mentioned order as shown in FIG. 2*a*. The tap winding 6 has an axial length which is substantially the same as that of the primary winding 3. The winding parts 12Na and 12Nb are respectively connected, at one end, to tap terminals 11A and 11B which, in turn, are connected in common to a terminal $T_1$. The tap terminals 11A and 11B are lead out from one end of the tap winding 6 and connected to the primary winding parts 3A and 3B of the primary winding 3, respectively. A tap terminal 12A derived from a connection line between the winding parts 12Na and 13Na, and a tap terminal 12B, derived from a connection line between the winding parts 12Nb and 13Nb, are connected in common to a terminal $T_2$. Similarly, a tap terminal 13A, derived from a connection line between the winding parts 13Na and 14Na, and a tap terminal 13B, derived from a connection line between the winding parts 13Nb and 14Nb, are connected in common to a terminal $T_3$; and a tap terminal 14A, derived from a connection line between the winding parts 14Na and 15Na, and a tap terminal 14B, derived from a connection line between the winding parts 14Nb and 15Nb, are connected in common to a terminal $T_4$. The winding parts 15Na and 15Nb are respectively connected, at the other end, to tap terminals 15A and 15B which, in turn, are connected in common to a terminal $T_5$. The tap terminals 15A and 15B are middle tap terminals of the series connected tap winding parts 12Na to 12Nb. When the tap selector 5 is transferred to the terminal $T_1$, no winding parts are inserted into the connection of the primary winding 3. With the terminal $T_2$ selected, the winding parts 12Na and 12Nb are inserted and similarly, with the terminal $T_5$ selected, the winding parts 12Na, 13Na, 14Na and 15Na as well as the winding parts 12Nb, 13Nb, 14Nb and 15Nb are inserted. In this manner, the single tap winding 6 can attain the same function as the two split-up tap windings of the prior art transformer. It is noted that only one end of the tap winding 6 is connected to the primary winding 3 by the tap terminals 11A and 11B.

When considering a leakage flux distribution permeating the tap winding 6, it is substantially the same as that in the two split-up tap windings of the prior art transformer shown in FIG. 1*b* since the arrangement of the secondary windings 2A and 2B and primary winding parts 3A and 3B is identical with the prior art one. Thus, the leakage flux distribution in this embodiment is depicted in FIG. 2*b*.

In FIG. 2*b*, the winding part 12Na of the tap winding 6 is positioned at a height $h_1$ where the flux density is $B_1$ and the winding part 12Nb is positioned at a height $h_2$ where the flux density is $B_2$. When only the secondary winding 2A is loaded, the leakage flux, as shown in solid lines 10A and 10C in FIG. 2*b*, takes place, so that a voltage proportional to the flux density $B_1$ develops in the winding part 12Na positioned at $h_1$ and a voltage proportional to the flux density $B_2$ develops in the winding part 12Nb positioned at $h_2$. On the other hand, the winding parts 12Na and 12Nb constitute a closed circuit through winding part 12Na, tap terminal 11A, terminal $T_1$, tap terminal 11B, winding part 12Nb, tap terminal 12B, tap $T_2$, tap terminal 12A and winding part 12Na. Thus, currents due to voltages induced in the winding parts 12Na and 12Nb, respectively, flows through the closed circuit in opposite directions, resulting in a circulating current corresponding to a voltage proportional to the difference between $B_1$ and $B_2$ of flux density.

Incidentally, the winding parts 12Na and 12Nb are positioned adjacently as shown in FIG. 2*a* with the distance between heights $h_1$ and $h_2$ minimized, so that the difference between $B_1$ and $B_2$ of flux density can also be minimized. It follows therefore that the difference between voltages induced in the winding parts 12Na and 12Nb can be minimized with a minimal attendant circulating current through the winding parts 12Na and 12Nb. This holds true for circulating currents flowing through the winding parts 13Na and 13Nb, the winding parts 14Na and 14Nb, and the winding parts 15Na and 15Nb.

Since in this embodiment the winding parts of the tap winding 6 to be connected to the same terminal of the tap selector are positioned adjacently, the circulating current can be minimized, thereby making it possible to reduce the load loss and eliminate adverse affect upon the impedance.

The paired tap winding parts in the tap winding are not necessarily disposed adjacent to each other, but may be disposed in intimate close relation or appreciable close relationship along the axial direction of the leg 1B.

Figure 3:
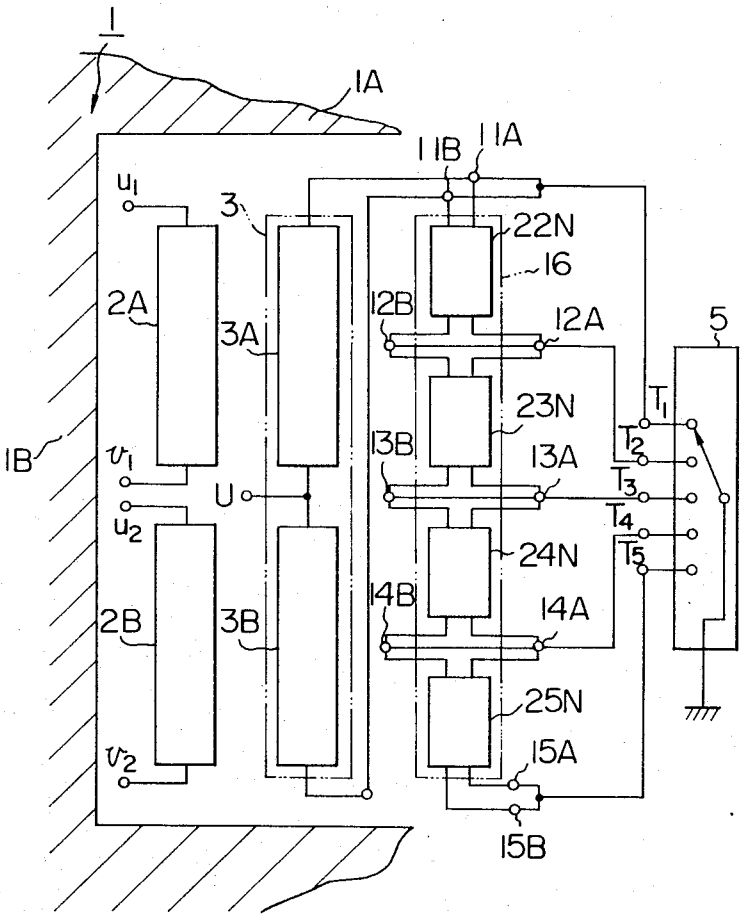

In FIG. 3, a single tap winding 16 like the FIG. 2*a* embodiment is employed. While, in the tap winding 6 of the first embodiment, the tap winding parts 12Na to 15Na and the tap winding parts 12Nb to 15Nb are alternately arranged along the axial direction of the leg 1B of core 1, the tap winding 16 of the embodiment of FIG. 3 has four tap winding parts 22N, 23N, 24N and 25N each including a composite winding of the adjacent winding parts as shown in FIG. 2*a* to be wound together in the radical direction, that is, of a pair of winding parts 12Na and 12Nb, a pair of winding parts 13Na and 13Nb, a pair of winding parts 14Na and 14Nb or a pair of winding parts 15Na and 15Nb.

More particularly, in the tap winding 16, each of the composite winding parts has two winding layers and two lead wires at either opposite end. For simplicity of description, tap terminals are designated by like reference characters depicted in FIG. 1*a*. With the tap winding 16 of FIG. 3, the positional difference along the axial direction of the leg 1B of core 1 can almost be nullified between the two winding layers (corresponding to the paired tap winding parts in FIG. 2*a*) in each of the composite winding parts and the magnitude of the circulating current can therefore be further reduced.

Figure 4:
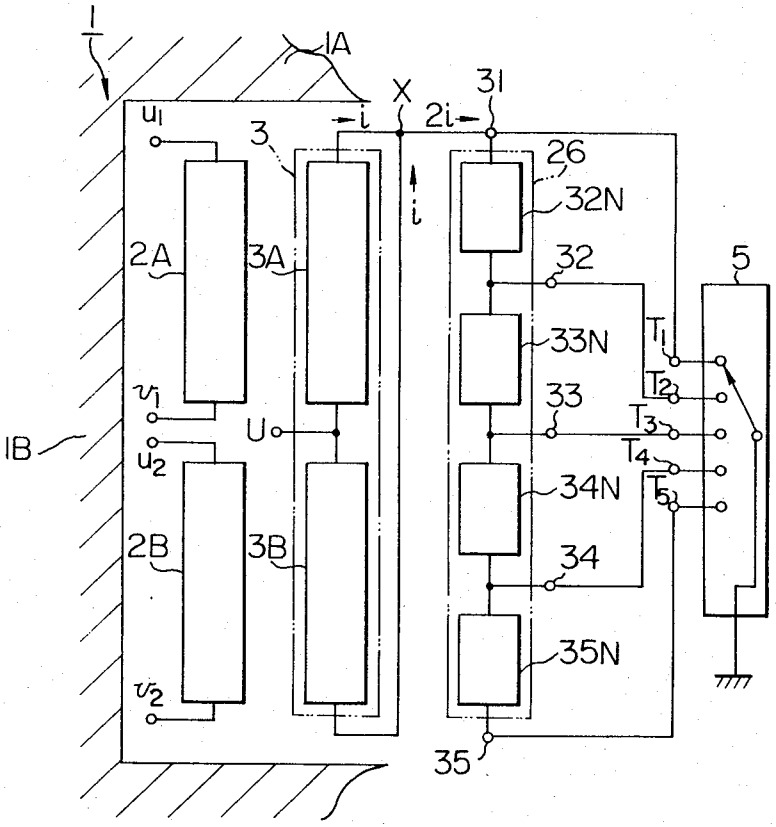
* and FIGS. 3, 4 and 5 are schematic views respectively illustrating second, third, and fourth embodiments of a split structure type transformer constructed in accordance with the present invention.

In FIG. 4, a single tap winding 26 is also used, with the tap winding 26 including four tap winding parts 32N, 33N, 34N and 35N, each including only one winding layer of one strand. The primary winding parts 3A and 3B of the primary winding 3 are connected in common, at one end, to a point X which, in turn, is connected to one end terminal 31 of the tap winding 36 having the tap winding parts 32N to 35N in series connection. The tap terminal 31, tap terminals 32, 33 and 34 derived from connection lines between adjacent tap winding parts and the other end tap terminal 35 of the tap winding 26 are respectively connected to terminals $T_1$, $T_2$, $T_3$, $T_4$ and $T_5$ of the tap selector 5. With this construction, no circulating current takes place since no loop is established through the tap winding parts.

Assuming that a current i flows through each of the primary winding parts 3A and 3B of the primary winding 3 in FIG. 4, a current of 2*i* flows through the strand of the tap winding 26. Accordingly, the strand of each of the tap winding parts is required to have a cross sectional area which allows the passage therethrough of a total of currents in the two primary winding parts 3A and 3B of the primary winding 3. The strand used in the embodiment of FIG. 4 has therefore a cross-sectional area which is twice a crosssectional area of a strand used for the tap winding part shown in FIG. 1*a*.

In the FIG. 4 embodiment, because of the series connection of the winding parts 32N to 35N in the tap winding 26, the number of tap lead wires to be connected to the tap selector 5 can be considerably reduced as compared to the prior art transformer and hence derivation and connection of the tap lead wires is simplified and is not time-consuming, thereby ensuring easy manufacture of the split structure type transformer.

Figure 5:
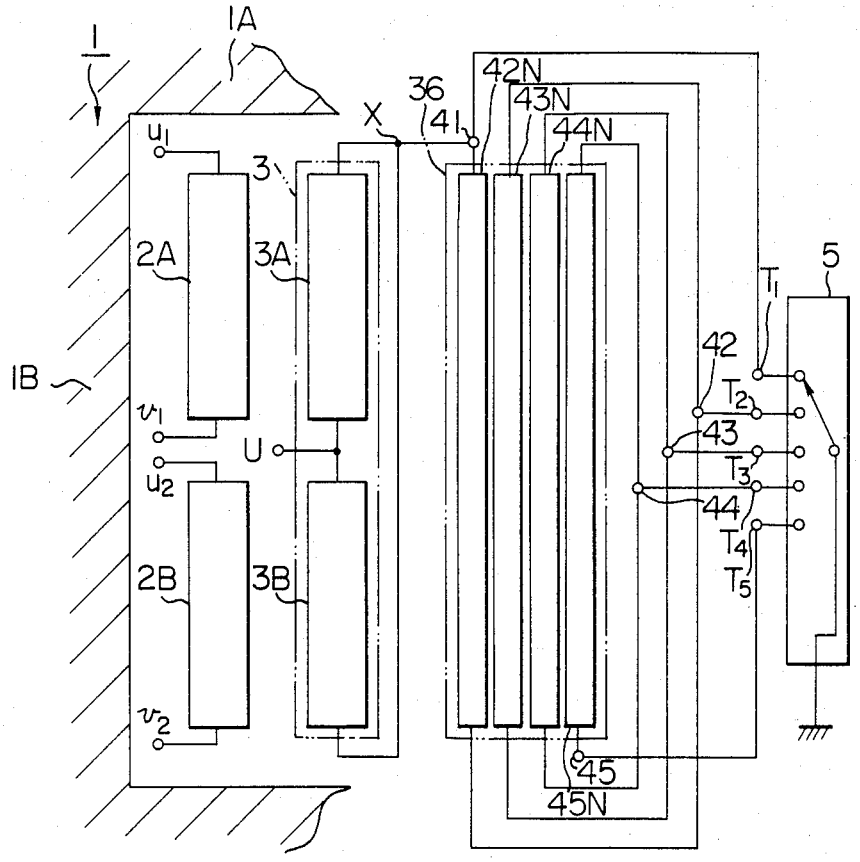

As shown in FIG. 5, a single tap winding 36 has tap winding parts 42N, 43N, 44N and 45N. The tap winding part 42N has a tap terminal 41 connected to a common junction X of the primary winding parts 3A and 3B and is connected, at the other end, to one end of the tap winding part 43N. In a similar manner, a series connection of the tap winding parts 42N to 45N is established. Like FIG. 4, the tap terminal 41, a tap terminal 42, derived from a connection line between the tap winding parts 42N and 43N, a tap terminal 43, derived from a connection line between the tap winding parts 43N and 44N, a tap terminal 44, derived from a connection line between the tap winding parts 44N and 45N, and a tap terminal 45 of the tap winding part 45N are respectively connected to terminals $T_1$, $T_2$, $T_3$, $T_4$ and $T_5$ of the tap selector 5. As in the FIG. 4 embodiment, no loop is established through the tap winding part in the FIG. 5 arrangement and no circulating current flows. The strand of each of the tap winding parts is required to have a cross-sectional area which allows the passage therethrough of a total of currents flowing through the two primary winding parts 3A and 3B.

Each of the tap winding parts 42N to 45N illustrated in FIG. 5 extends over full length but it may be split up into upper and lower sub-sections in the axial direction and these sub-sections may be connected in series to constitute each tap winding part.

As described above, according to the embodiments shown in FIGS. 4 and 5, the tap winding is connected in series with the split-up primary winding parts and with this construction, no closed circuit is established between the tap winding and the tap selector wherever any tap is selected and no circulating current occurs, thereby making it possible to provide the split structure type transformer which can considerably reduce the load loss and impedance error.

What is claimed is:

1. A split structure type transformer comprising:

a core having a leg;

two split secondary windings wound about the leg of the core to be juxtaposed along an axial direction of the leg, and connectable to independent loads;

a primary winding including two primary winding parts each being wound about each of said two secondary windings corresponding thereto and concentrically therewith to be juxtaposed along the axial direction of said leg said two primary winding parts being connected in parallel to each other;

a single tap winding wound about both the primary winding parts of said primary winding and secondary windings concentrically therewith and including a plurality of tap winding parts connected in series with each other and a plurality of tap terminals, only one end of said single tap winding is connected to a common terminal of the parallel connected primary winding parts so that a sum of currents flowing through said two primary winding parts is applied to said one end of said single tap winding; and a single tap selector connected to the tap terminals of said single tap winding to select one of the tap terminals.

2. A split structure type transformer according to claim 1, wherein the other end of said tap winding is connected to said tap selector.

3. A split structure type transformer comprising:

a core having a leg;

two split secondary windings wound about the leg of the core along an axial direction of the leg and connectable to independent loads;

a primary winding including two primary winding parts wound about said two secondary windings corresponding thereto and concentrically therewith along the axial direction of said leg, said two primary winding parts being connected in parallel to each other;

a single tap winding wound about said primary winding and secondary windings concentrically therewith and including a plurality of series connected tap winding parts comprising a first half of the tap winding parts ranging from a first end tap terminal of the series connected winding parts to a middle tap terminal thereof, a second half of the tap winding parts ranging from a second end tap terminal of the series connected winding parts to a middle tap terminal thereof the tap winding parts in the first half are arranged adjacent to and connected in parallel with the corresponding tap winding parts in the second half, said first and second end terminals being lead out from said one end of said tap winding;

a single tap selector connected to the tap terminals of said tap winding to select one of the tap terminals;

wherein only one end of said tap winding is connected to said primary winding.

4. A split structure type transformer according to claim 3, wherein the tap winding parts in the first the second halves are arranged alternately along the axial direction of said leg of the core.

5. A split structure type transformer according to claim 3, wherein a pair of strands are wound to form a composite tap winding part of each adjacently arranged tap winding parts.

6. A split structure type transformer according to claim 5, wherein said pair of strands in each of said composite tap winding parts are replaced by a single strand.

7. A split structure type transformer according to claim 3, wherein said first and second end tap terminals are connected to said first and second primary winding parts of the primary winding, respectively.

8. A split structure type transformer comprising:

a core having a leg;

two split secondary windings wound about the leg of the core to be juxtaposed along an axial direction of said leg and connectable to independent loads;

a primary winding including first and second primary winding parts each being wound about each of said secondary windings corresponding thereto and concentrically therewith to be juxtaposed along the axial direction of said leg, said first and second primary winding parts being connected in parallel, whereby said primary winding has a first common terminal to be connected to a power source and a second common terminal;

a single tap winding wound by a single strand about the fist and second primary winding parts of said primary winding and secondary windings concentrically therewith and including a plurality of tap winding parts connected in series, and a plurality of tap terminals including two end terminals;

wire means for interconnecting said second common terminals of said primary winding and only one of said end terminals of said single tap winding so that currents flowing through said parallel connected primary winding parts are summed and applied to said one end terminal of said single tap winding; and a single tap selector connected to said tap terminals of said single tap winding to select one of said tap terminals.

9. A split structure type transformer according to claim 8, wherein said single strand has a cross-sectional area which allows the passage therethrough of a total of currents flowing through said first and second primary winding parts of said primary winding.

* * * * *